US006116144A

United States Patent [19]

Rosenfeldt et al.

[11] Patent Number: 6,116,144

[45] Date of Patent: Sep. 12, 2000

[54] PRESSURE MOTOR FOR ELECTRO-RHEOLOGICAL FLUIDS

[75] Inventors: Horst Rosenfeldt, Gross-Zimmern; Dorothea Adams, Büttelborn; Horst Scherk, Ober-Ramstadt; Eckhardt Wendt, Leverkusen; Klaus Büsing, Köln; Gerald Fees, Aachen, all of Germany

[73] Assignees: Bayer Aktiengesellschaft, Leverkusen; Carl Schenck Aktiengesellschaft, Darmstadt, both of Germany

[21] Appl. No.: 09/132,609

[22] Filed: Aug. 11, 1998

[30] Foreign Application Priority Data

Aug. 16, 1997 [DE] Germany ..... 197 35 466

[51] Int. Cl.[7] ..... F15B 13/044

[52] U.S. Cl. ..... 91/459; 91/418

[58] Field of Search ..... 91/418, 459; 60/326

[56] References Cited

U.S. PATENT DOCUMENTS

| | | | |
|---|---|---|---|
| H1292 | 3/1994 | Marsh | 60/326 |
| 3,050,034 | 8/1962 | Benton | 91/459 X |
| 3,599,428 | 8/1971 | Chaney et al. | 91/459 X |
| 3,635,016 | 1/1972 | Benson | 91/459 X |
| 4,342,334 | 8/1982 | Stangroom | 91/459 X |
| 4,926,985 | 5/1990 | Mizuno | 188/378 |
| 4,959,581 | 9/1990 | Dantlgraber | 137/625.61 X |
| 5,014,829 | 5/1991 | Hare, Sr. | 188/267 |
| 5,158,109 | 10/1992 | Hare, Sr. | 137/514.3 |
| 5,161,653 | 11/1992 | Hare, Sr. | 188/267 |
| 5,170,866 | 12/1992 | Ghaem | 188/267 |
| 5,377,721 | 1/1995 | Kiyohiro et al. | 91/405 X |
| 5,866,971 | 2/1999 | Lazarus et al. | 310/328 |

*Primary Examiner*—John E. Ryznic
*Attorney, Agent, or Firm*—Norris, McLaughlin & Marcus, P.A.

[57] ABSTRACT

In a pressure motor for electro-rheological fluids comprising a housing (1) surrounding two operating chambers (A, B), a piston (3) moveable in the housing (1), an inlet channel (22) for supplying, and an outlet channel (23) for discharging an electro-rheological fluid, and electro-rheological valves (1a, 1b, 2a, 2b) comprising an annular gap (8) which in each case connects an operating chamber (A and B) to the inlet channel (22) or the outlet channel (23) and whose boundary surfaces form electrodes for the generation of an electric field, the electro-rheological valves (1a, 1b, 2a, 2b) are formed by bores (6) which penetrate through the housing wall in the longitudinal direction and by mandrels (7) which are arranged in the bores (6) and are insulated from the housing (1), where the bores (6) and the mandrels (7) co-define annular gaps (8) of a constant gap width and the mandrels (7) can be connected to a high voltage and the housing (1) can be connected to earth potential.

7 Claims, 4 Drawing Sheets

PRESSURE MOTOR FOR ELECTRO-RHEOLOGICAL FLUIDS

The invention relates to a pressure motor for electro-rheological fluids, comprising a housing which surrounds two operating chambers, a piston which is moveable in the housing and which separates the operating chambers from one another, an inlet channel for supplying an electro-rheological fluid from a higher-pressure area, an outlet channel for discharging the electro-rheological fluid into a low-pressure area, and electro-rheological valves comprising an annular gap which in each case connects an operating chamber to the inlet channel or the outlet channel and whose boundary surfaces form electrodes for the generation of an electric field.

Electro-rheological fluids, also referred to as electro-viscous fluids, change their viscosity as a function of the field strength of an electric field to which they are exposed. Under the effect of an electric field electro-rheological fluids become viscous or even stiff. It is known to use electro-rheological fluids as operating fluid in hydraulic systems to permit the direct electrical control of hydraulic processes with the aid of electro-rheological valves.

U.S. Pat. No. 4,840,112 A has disclosed a pressure motor in the form of a differential cylinder provided as servo-motor for aircraft and operated with an electro-rheological fluid. The control takes place via electro-rheological valves which are integrated into the cylinder. The four valves consist of annular gaps formed by the insertion of two tubes into the cylinder. The piston of the cylinder extends through the inner tube. The electro-rheological fluid is supplied and discharged via connecting pieces which are arranged in the cylinder wall centrally between the two end sides of the cylinder. As a result of the short connection between the valves and the cylinder chambers, in this known design the high response speed of the electro-rheological fluid can be well utilized. For the formation of the required four valves, in the known arrangement it is necessary to subdivide the two annular gaps formed by the tubes so that in each case two valves per annular gap are to be accommodated along the length of the cylinder. This leads to a long overall length of the cylinder as the length of the annular gaps have a bearing on the attainable pressure difference and thus upon the adjusting forces of the pressure motor. Furthermore, the piston diameter is linked to the circumference of the annular gaps and thus to the input cross-section of the fluid into the annular gaps, so that all the necessary geometric dimensions of the annular gaps are substantially fixed and can no longer be optimised in accordance with different principles, for example the control of the high voltage. A further disadvantage consists in that the heat arising in the inner annular gap as a result of the viscous friction cannot be discharged to the exterior by direct metallic thermal conduction. Therefore, in particular at high frequencies of the piston movement, intense heating of the electro-rheological fluid in the inner annular gap can occur.

The object of the invention is to provide a pressure motor of the type referred to in the introduction having integrated valves which, with compact outer dimensions, permits a high differential pressure between the two operating chambers and thus a relatively high adjusting force, attains a high dynamic response, and wherein good heat discharge is achieved by direct metallic thermal conduction.

The object is achieved in accordance with the invention in that the electro-rheological valves are formed by bores which penetrate through the housing wall in the longitudinal direction and by elements which are arranged in the bores and are insulated from the housing, where the bores and the elements co-define annular gaps of a constant gap width and the elements can be connected to a high voltage and the housing can be connected to earth potential.

In the design of the pressure motor according to the invention, the electrode gaps of the electro-rheological valves can extend along the entire length of the housing so that a high pressure difference, measured along the overall length of the pressure motor, can be obtained. All the annular gaps are in direct contact with the housing wall, which can be produced from a metal, thus ensuring a good heat discharge. Each valve can be formed by a plurality of bores with high-voltage elements. Therefore a large cross-sectional area of the valves, and thus a high volume flow and high dynamic response of the pressure motor, are attainable. The design of the pressure motor according to the invention also facilitates a mechanically simple construction comprising identical components, namely bores and elements of identical dimensions, for the formation of the four valves. In a simple embodiment the elements can consist of cylindrical rods or mandrels but can also have the form of a coil extending along the bore.

In accordance with the invention, the ends of the elements projecting from the bores can be mounted in end caps which are fixed to the end sides of the housing and are produced from highly insulating material, for example industrial thermoplastics such as PPS or ceramic. The end caps can also form chambers by means of which the annular gaps of the valves are connected to the inlet channel and to the outlet channel or an operating chamber. This has the advantage that the entire annular gap cross-section is available as input cross-section. The four valves can be connected via the chambers in the end caps to the operating chambers and to the inlet channel and outlet channel in two different ways. In one embodiment the inlet channel and outlet channel are arranged on one end side of the housing and the valves are connected to the operating chambers via the other end side of the housing. This embodiment has the advantage that a unit comprising motor, pump and tank or store can be flange-attached to one end face of the pressure motor, resulting in a very compact overall mechanical construction of an assembly which can be used for example in industrial robots for accurate positioning or as a steering aid for cars or lorries. As the electro-rheological fluid has a very high response speed of normally 1 ms, such an assembly can also be used as high-frequency cylinder for material testing.

In the second embodiment the inlet channel and outlet channel lead to chambers on both end sides of the housing where they are each connected to the annular gaps of another valve. In the case of all four valves this results in very short connection paths to the respective operating chamber.

In the following the invention will be explained in detail in the form of an exemplary embodiment which is illustrated in the drawing wherein.

Figure 1:
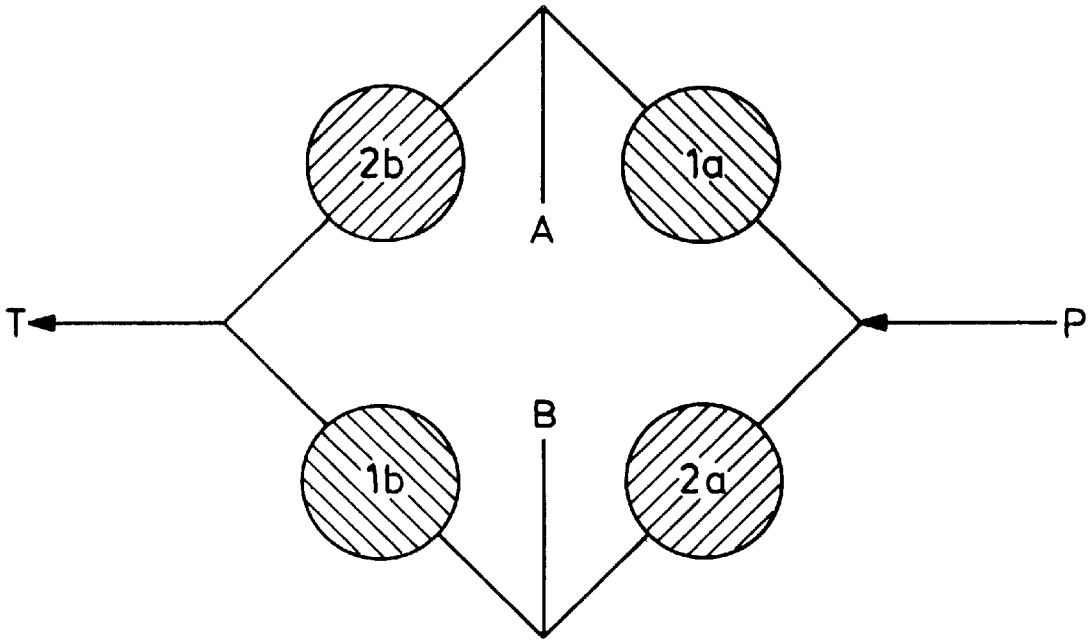
FIG. 1 is a block diagram of a pressure motor according to the invention.
Figure 2:
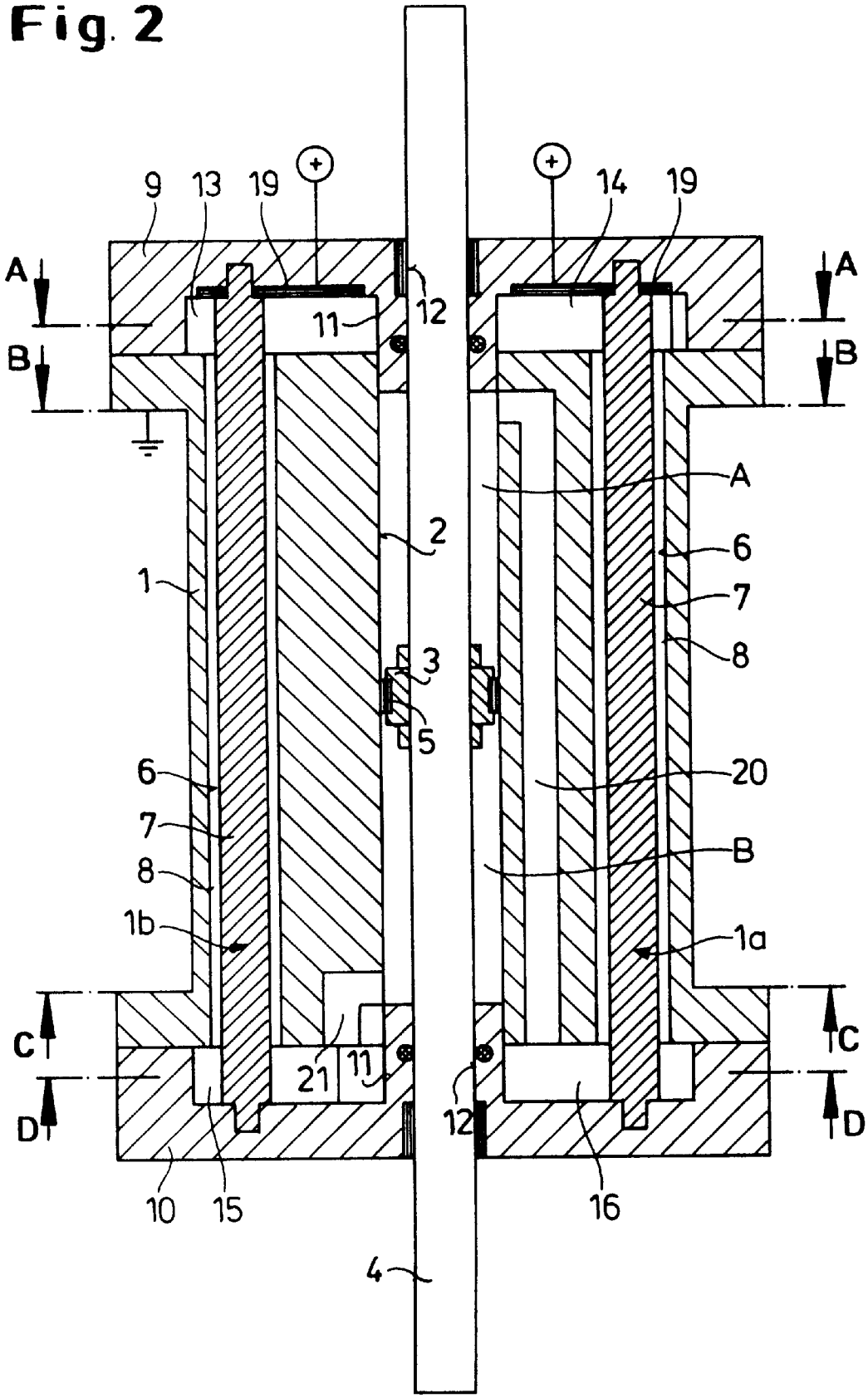
FIG. 2 is a longitudinal section E—E through a pressure motor according to the invention for electro-rheological fluids comprising a cylindrical housing and annular gap valves integrated into the housing.
Figure 3:
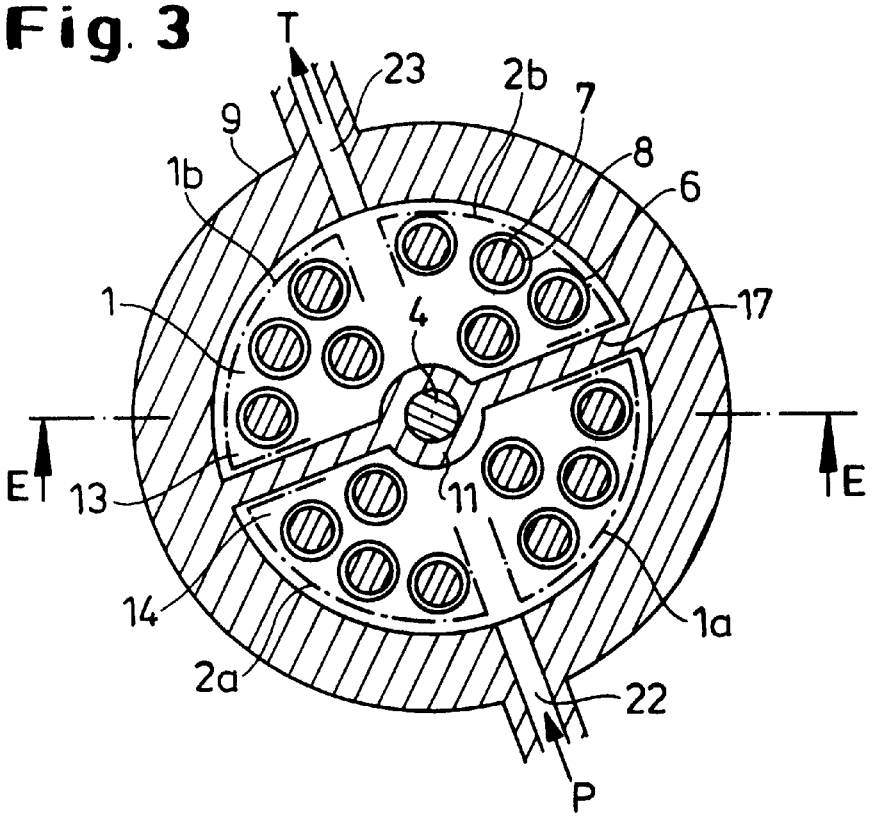
FIG. 3 is a cross-section A—A of the pressure motor according to FIG. 2.
Figure 4:
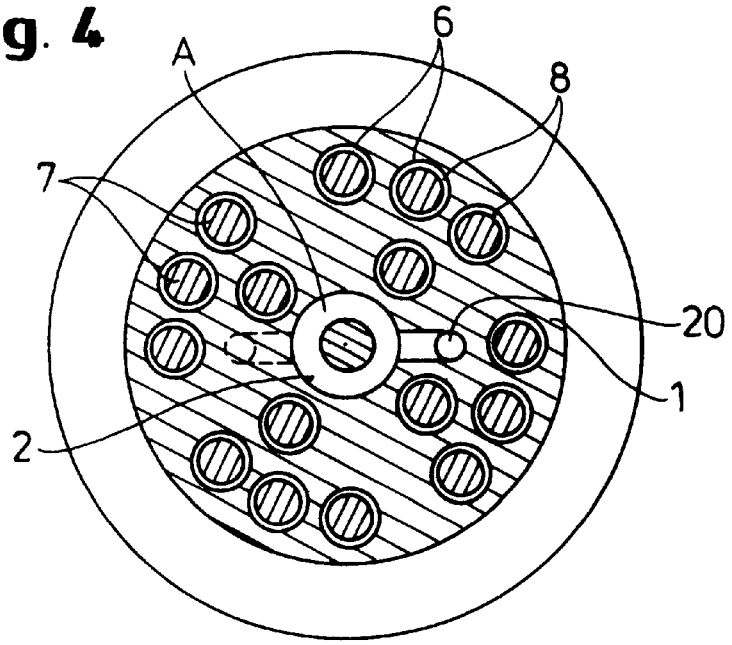
FIG. 4 is a cross-section B—B of the pressure motor according to FIG. 2.
Figure 5:
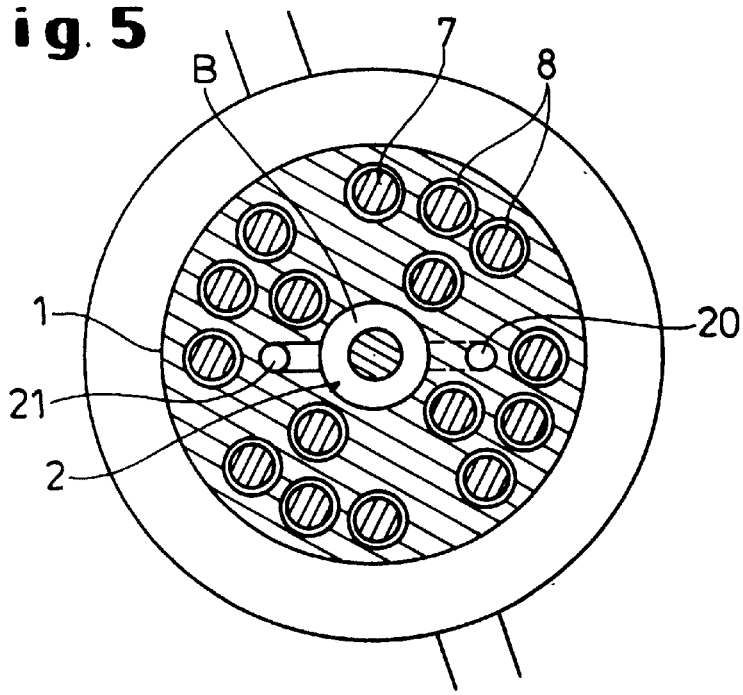
FIG. 5 is a cross-section C—C of the pressure motor according to FIG. 2
Figure 6:
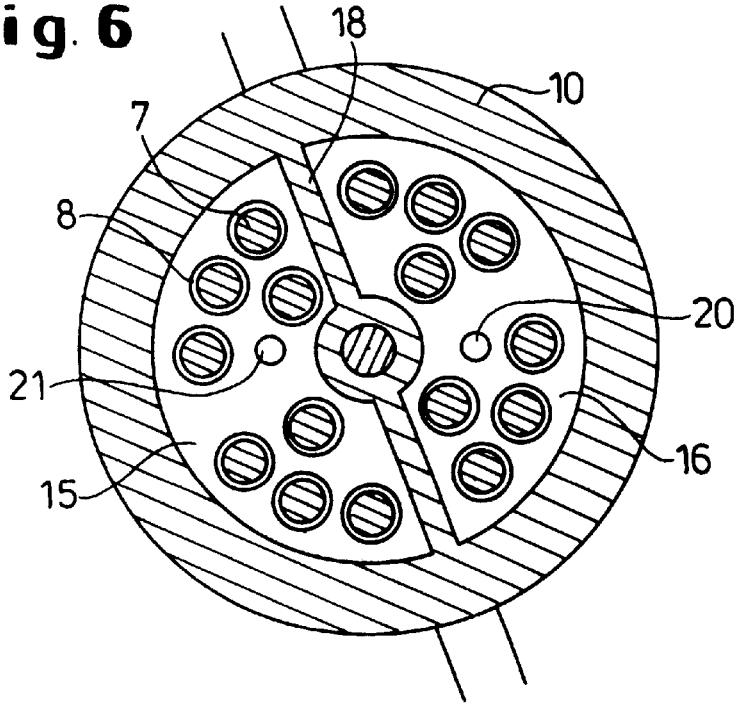
FIG. 6 is a cross-section D—D of the pressure motor according to FIG. 2.

FIG. 1 illustrates the mode of operation of the pressure motor operating with an electro-rheological fluid and described in detail in the following. The lines designate the flow channels through which the electro-rheological operating fluid is conveyed from a pump P to an unpressurized container T. Two parallel flow channels extend between the pump P and the container T. The upper channel contains the serially arranged annular gap valves 1*a* and 2*b* represented by circular areas, while the lower flow channel contains the annular gap valves 2*a* and 1*b,* in each case viewed in the direction of flow. Between the annular gap valves 1*a,* 2*b* the one operating chamber A of the pressure motor is connected to the upper flow channel, while between the annular gap valves 2*a,* 1*b* the other operating chamber B of the pressure motor is connected to the lower flow channel.

If the piston separating the operating chambers A, B is to be moved in the direction of the chamber A, the annular gap valves 1*a,* 1*b* are blocked by the connection of a high voltage, i.e. the viscosity of the electro-rheological operating fluid within the annular gap is increased by the electric field which is generated in the annular gap by the high voltage, such that only a fraction of the conveyed quantity of fluid can overcome the resultant flow resistance and pass through the annular gap valves 1*a,* 1*b.* This leads to an increase in pressure at the pump output and in the operating chamber B connected thereto via the annular gap valve 2*a* switched into the open state. The pressure in the operating chamber A remains however at the low level of the container T as the valve 2*b* is likewise open. Due to the pressure difference between the operating chamber B and the operating chamber A, the piston is moved in the direction of the operating chamber A.

If the piston is to be moved in the direction of the operating chamber B, the annular gap valves 2*a,* 2*b* are blocked by the connection of a high voltage and the annular gap valves 1*a,* 1*b* become de-energised and are thus switched into the open state. If the valves are switched rapidly to and fro, the piston can be caused to oscillate in accordance with the switching frequency.

The pressure motor illustrated in FIGS. 2 to 6 has a cylindrical housing 1 made of metal. The housing 1 comprises a central, continuous cylindrical bore 2 in which a piston 3 with a piston rod 4 is mounted so as to be axially moveable. The piston 3 is sealed from the wall of the cylindrical bore 2 by a sliding seal 5 and subdivides the cylindrical bore 2 into two operating chambers A, B. A series of cylindrical bores 6 completely penetrating the housing 1 and of uniform diameter are provided in the wall of the housing 1 in parallel to the cylindrical bore 2. Metallic cylindrical mandrels 7 extend through the bores 6, said mandrels having a smaller diameter than the bores 6 and being centred relative to the bores. This arrangement gives rise to annular gaps 8 of a constant gap width between the wall of the bores 6 and the mandrels 7. The ends of the mandrels 7 projecting from the bores 6 are mounted in end caps 9, 10 which are fixed to both end faces of the housing 1 in pressure-tight manner. The end caps 9, 10 consist of an insulating material, for example PPS or polycarbonate, which can be strengthened with fillers, for example glass fibres. At their centre the end caps 9, 10 comprise a cylindrical projection 11 which in each case engages into the end of the cylindrical bore 2 and closes this bore. Additionally the end caps 9, 10 are provided with central through-bores 12 in which the piston rod 4 is guided and is sealed.

On their side facing towards the housing 1, the end caps 9, 10 each comprise two semi-cylindrical chambers 13, 14 and 15, 16 which are separated from one another by a respective radial wall 17, 18. The walls 17, 18 are aligned with one another such that their central planes extend at right angles to one another. The annular gaps 8 arranged in the corresponding cylinder half of the housing 1 lead into the chambers 13 to 16. By virtue of the arrangement of the chambers 13, 14 in a position rotated by 100° relative to the chambers 15, 16, only the four annular gaps 8 situated in a quadrant of the cylindrical housing 1 interconnect two chambers arranged on opposite end sides of the housing 1. Consequently this gives rise to four groups of annular gaps 8 which in each case form a different flow path. Each of the four groups of annular gaps forms an electro-rheological annular gap valve 1*a,* 1*b,* 2*a,* 2*b.* The mandrels 7 of each annular gap valve are connected to one another in the end cap 9 by a high-voltage distributor 19 and can each be connected to a high-voltage source independently of the mandrels of the other annular gap valves. The housing 1 is connected to earth potential. If high voltage is applied to the mandrels 7 of an annular gap valve, an electric field is generated in the annular gaps 8 of this annular gap valve and an increase occurs in the viscosity of the electro-rheological operating fluid present in the annular gaps 8 of this valve.

To obtain the control function described in conjunction with FIG. 1, the chamber 16 is connected to the operating chamber A via a channel 20 in the housing 1 and the chamber 15 is connected to the operating chamber B via a channel 21 in the housing 1. The chamber 14 is connected to the inlet channel 22 and the chamber 13 to the outlet channel 23. The operating fluid supplied to the chamber 14 via the inlet channel 22 can thus either enter the chamber 16 via the annular gap valve 1*a* or can enter the chamber 15 via the annular gap valve 2*a.* Accordingly the operating fluid can in each case be discharged into the chamber 13 from the chamber 16 via the annular gap valve 2*a* and from the chamber 15 via the annular gap valve 1*b,* and from the chamber 13 can be discharged into the outlet channel 23.

The described invention is equally suitable for pressure motors operating with a magneto-rheological operating fluid. Instead of an electric field, a magnetic field is then to be formed in the annular gaps with the aid of suitable coils.

We claim:

1. A pressure motor for electro-rheological fluids comprising a housing surrounding two operating chambers, a piston which is moveable in the housing and which separates the operating chambers from one another, an inlet channel for supplying an electro-rheological fluid from a higher-pressure area, an outlet channel for discharging the electro-rheological fluid into a low-pressure area, and electro-rheological valves comprising an annular gap which in each case connects an operating chamber to the inlet channel or outlet channel and whose boundary surfaces form electrodes for the generation of an electric field, characterised in that the electro-rheological valves (1*a,* 1*b,* 2*a,* 2*b*) are formed by bores (6) which penetrate through the housing wall in the longitudinal direction and by elements (mandrels 7) which are arranged in the bores (6) and are insulated from the housing (1), where the bores (6) and the elements (mandrels 7) co-define annular gaps (8) of a constant gap width and the elements (mandrels 7) can be connected to a high voltage and the housing (1) can be connected to earth potential.

2. A pressure motor according to claim 1, characterised in that the ends of the elements (mandrels 7) projecting from the bores are mounted in end caps (9, 10) which are fixed to the end faces of the housing (1) and are produced from highly insulating material.

3. A pressure motor according to one of claim 1, characterised in that the end caps (9, 10) form chambers (13, 14,

15, 16) by means of which the annular gaps (8) of the valves (1*a,* 1*b,* 2*a,* 2*b* ) are connected to the inlet channel (22) and to the outlet channel (23) or to an operating chamber (A, B).

4. A pressure motor according to claim 1, characterised in that the inlet channel (22) and the outlet channel (23) are arranged on one end side of the housing (1) where they are in each case connected to two valves (1*a,* 2*a* and 1*b,* 2*b* ), and that the valves (1*a,* 1*b,* 2*a,* 2*b* ) are connected to the operating chambers (A, B) on the other end side of the housing (1).

5. A pressure motor according to claim 1, characterised in that a unit comprising motor, pump and tank and/or store is flange-attached to an end face of the pressure motor.

6. A pressure motor according to claim 1, characterised in that the inlet channel (22) and the outlet channel (23) lead to both end sides of the housing (1) where they are in each case connected to the annular gap of another valve.

7. A pressure motor according to claim 1, characterised in that it is intended for magneto-rheological fluids and the valves are designed as magneto-rheological valves such that a magnetic field can be generated between the housing and the elements.

* * * * *